United States Patent [19]

Cooksey

[11] 3,967,402

[45] July 6, 1976

[54] MANUALLY-OPERATED FIREARM WITH FORWARD-MOVING BARREL AND PIVOTED BREECH BLOCK

[75] Inventor: George E. Cooksey, East Moline, Ill.

[73] Assignee: The United States of America as represented by the Scretary of the Army, Washington, D.C.

[22] Filed: Jan. 22, 1975

[21] Appl. No.: 543,100

[52] U.S. Cl. ..... 42/10; 42/1 F; 42/26; 42/38

[51] Int. Cl.[2] ..... F41C 11/00

[58] Field of Search ..... 42/10, 1 F, 26, 28, 42/30, 31, 34, 36, 38

[56] References Cited

UNITED STATES PATENTS

| | | | |
|---|---|---|---|
| 3,332,162 | 7/1967 | Martwick et al. | 42/1 F |
| 3,408,761 | 11/1968 | Silsby | 42/1 F |
| 3,641,691 | 2/1972 | Ellis et al. | 42/1 F |

*Primary Examiner*—Charles T. Jordan
*Attorney, Agent, or Firm*—Nathan Edelberg; A. Victor Erkkila; Thomas R. Webb

[57] ABSTRACT

The disclosed firearm comprises a stationary receiver or frame, a breech block pivotally mounted at its lower end on the receiver and engaging a forward-facing abutment on the receiver in firing position, a barrel slidably mounted near its forward end on the receiver and pivotally connected at its rear end to the upper end of the breech block. Forward movement of the barrel to open the breech at the rear of the barrel bore during firing is prevented by the pivotal connection and the firing reaction on the breech block. The barrel can be moved forward after firing to move the rear end thereof forward and downward to open the breech. The firearm also includes a barrel latch automatically released by the hammer during firing, an extractor-ejector member actuated by the breech block during the opening of the breech, and a hammer-cocking means also actuated by the opening of the breech.

10 Claims, 6 Drawing Figures

MANUALLY-OPERATED FIREARM WITH FORWARD-MOVING BARREL AND PIVOTED BREECH BLOCK

GOVERNMENTAL INTEREST

The invention described herein may be manufactured, used and licensed by or for the Government for governmental purposes without the payment to me of any royalty thereon.

BACKGROUND AND SUMMARY OF THE INVENTION

This invention relates to manually-operated breech-loading firearms, and particularly to such firearms having a barrel that is moved forwardly after firing to open the breech. Firearms of this type normally are provided with means for mechanically locking the barrel and breech block in closed position during firing, and such means must be released after firing to open the breech.

An object of the present invention is to eliminate the usual mechanical locking means, and provide a firearm with pivotal connections between the breech block, the barrel and the receiver that effectively lock the breech block and barrel together during firing and automatically release the barrel after firing to permit the opening of the breech.

In accordance with the invention, the firearm comprises a stationary receiver or frame, a breech block pivoted at one end on the receiver, a barrel slidably mounted at its forward end on the receiver and pivotally connected at its rear end to the other end of the breech block, whereby forward movement of the barrel during firing is prevented by the firing reaction on the breech block, but the barrel can be moved forward after firing to move its rear end forward and outward, to open the breech. A latch may be provided for locking the breech block in closed position prior to firing, with means for automatically releasing the latch at firing. Means may be provided for cocking of the firing mechanism by the breech block during the opening of the breech. Means may also be provided for actuating an extractor-ejector member by the breech block during the opening of the breech.

This invention is an improvement over a broader prior invention of George L. Reynolds, disclosed and claimed in copending application entitled "Manually-Operated Firearm With Forward-Moving Barrel And Automatic Breech Lock", Ser. No. 543,101, filed Jan. 22, 1975, with the same assignee.

DETAILED DESCRIPTION OF THE PREFERRED EMBODIMENTS

FIGS. 1A through 3 show a manually-operated breech-loading firearm 1 embodying the present invention. The particular firearm shown, as an example, is a dual rifle (e.g. .22 caliber) and grenade launcher (e.g. 30mm), and the invention is incorporated in the grenade launcher portion. However, it should be understood that the invention is not limited to such application.

Figure 1A:
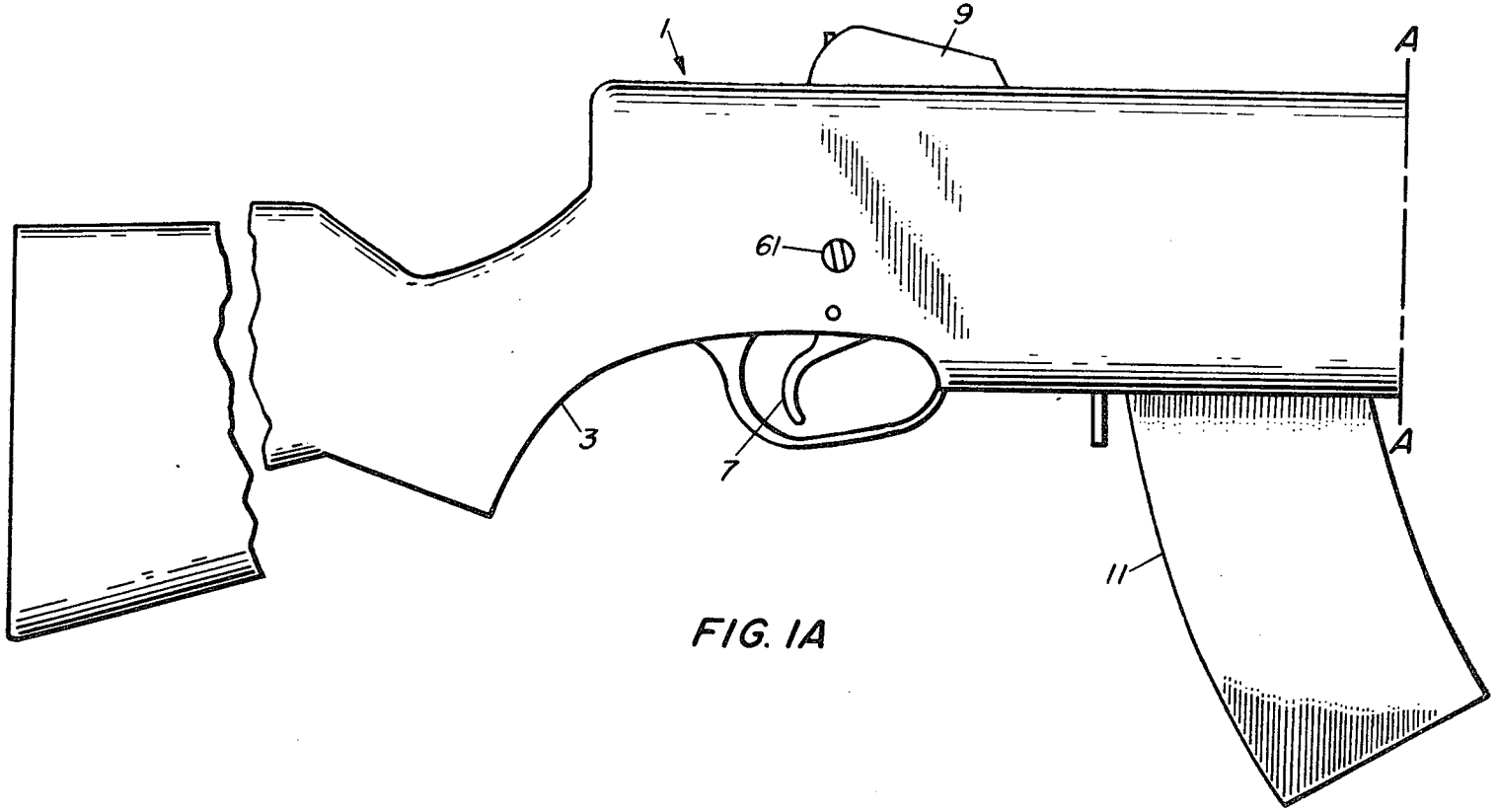
FIG. 1A is a right side view of the rear portion of a firearm embodying the present invention.
Figure 1B:
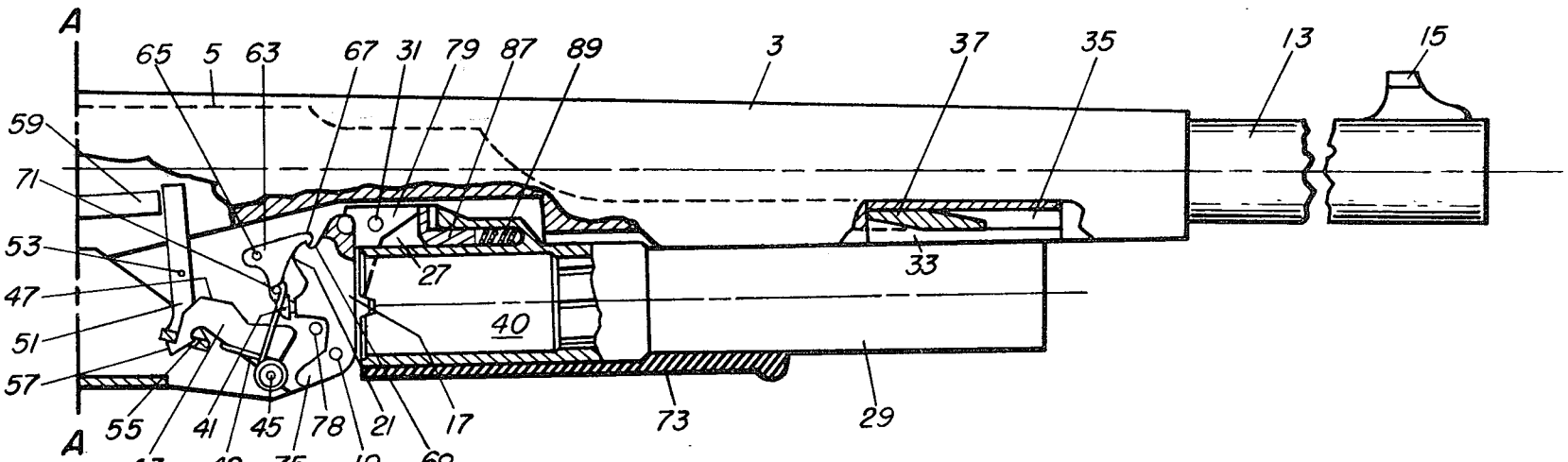
FIG. 1B is a similar view, partly in axial section, of the front portion of the firearm, with the breech closed.

The firearm 1 comprises a stock 3, which is preferably of non-metallic material, such as a plastic, and encloses all of the gun parts except the magazine and barrels, as shown in FIGS. 1A and 1B. A metal receiver or frame 5, mounted within the forward portion of stock 3, supports the various mechanical parts of the firearm. The rifle portion of the firearm 1 comprises a trigger 7, rear sight 9, cartridge magazine 11, barrel 13 (omitted in FIGS. 2–5), and front sight 15.

Figure 3:
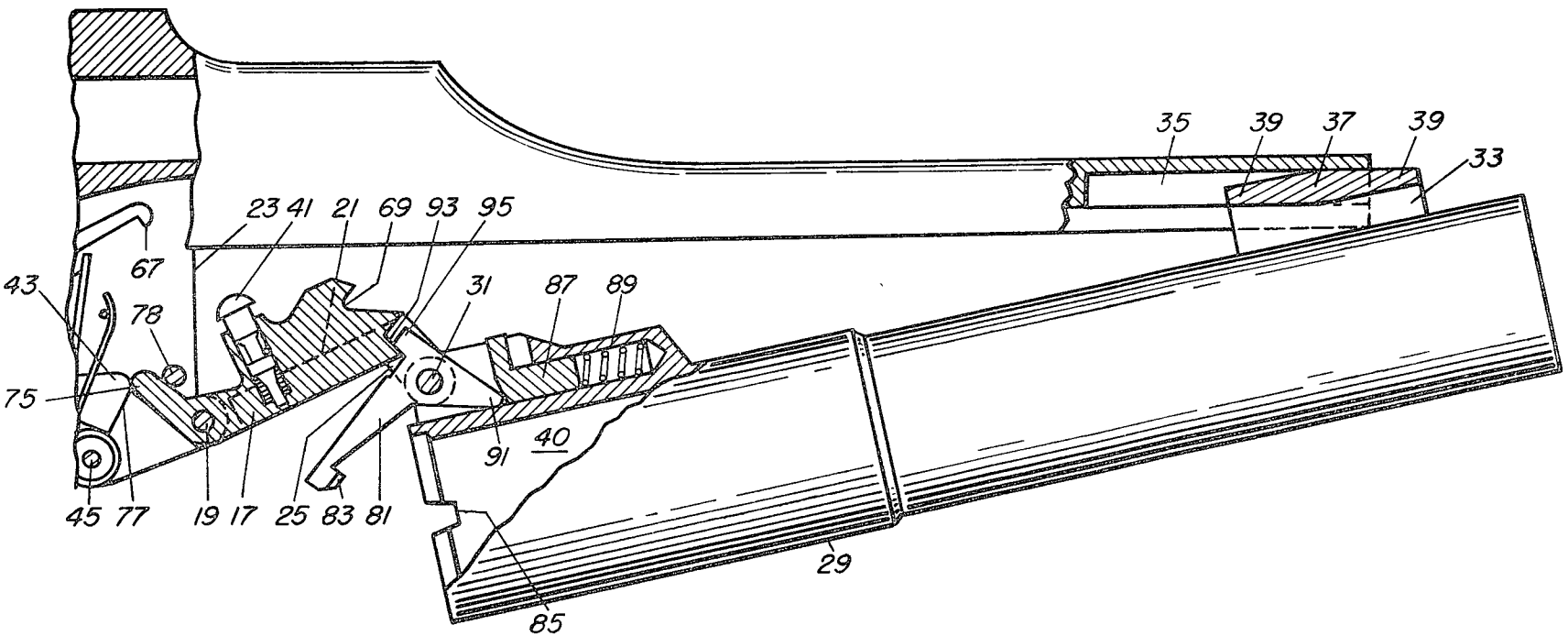
FIG. 3 is a similar view, with the breech in fully open position.

The barrel, breech block and firing mechanism of the grenade launcher are mounted in or on the receiver 5 forward of the magazine 11 and the rifle breech (not shown). An elongated breech block 17 is oriented vertically in firing position, pivoted at its lower end, at 19, in the receiver 5, and has a rear portion 21 engageable with a forward-facing abutment 23 on the receiver 5 during firing. The upper end of the breech block 17 has a forward-extending arm 25 to which an upward-extending lug 27 on a grenade barrel 29 is pivotally connected, at 31. The forward end of barrel 29 is slidably mounted on the receiver 5 by means of a T-shaped barrel projection 33 slidable in a T-shaped longitudinal groove 35 in the front end of the receiver 5. The upper and lower surfaces of the head 37 of projection 33 are shaped to form opposed wedges 39, to permit the rear end of the barrel 29 to swing downward, as shown in FIG. 3.

As shown in FIG. 1B, the front face of the breech block 17 abuts the rear end of the barrel chamber 40 in firing position. The firing mechanism comprises a rearward-biased firing pin 41 slidably carried by the breech block 17, and a firing hammer 43 pivoted in the receiver at 45 and having a face 47 adapted to strike the firing pin 41 under the bias of a leaf spring 49. Hammer 43 is held in the cocked position shown in FIG. 1B prior to firing by a sear lever 51, pivoted at 53 and having a slot 55 engageable with a tooth 57 on the hammer 43. The sear 51 is actuated by a trigger bar 59 to release the hammer 43 for firing. Trigger ar 59 may be actuated by a separate bar or by the rifle trigger 7 by means of a selector element 61 (FIG. 1A).

In order to lock the breech block 17 and barrel 29 in closed position prior to firing, a breech block latch 63 may be provided, in the form of a lever pivoted at 65 in the receiver 5 and having a hook 67 engageable with a notch 69 in the upper end of the breech block 17. The latch 63 has a laterally-extending pin 71 at its lower end which is struck by the hammer face 47 during firing to release the breech block, for opening the breech after firing.

After firing, the breech is opened, for ejecting the fired case from the barrel chamber 40, by manually moving the barrel 29 forward, by means of a barrel grip 73. As the barrel 29 moves forward, the breech block 17 pivots forward and downward, forcing the rear end of the barrel to move downward to the open breech position of FIG. 3. As the breech block 17 pivots forward, a rearward-extending arm 75 thereon engages a cam surface 77 on the hammer 43 and pivots the hammer rearward to the cocked position shown in FIG. 1B. The pivotal movement of the breech block 17 is terminated by engagement of the arm 75 with a stop pin 78 mounted in the receiver 5.

Figure 2:
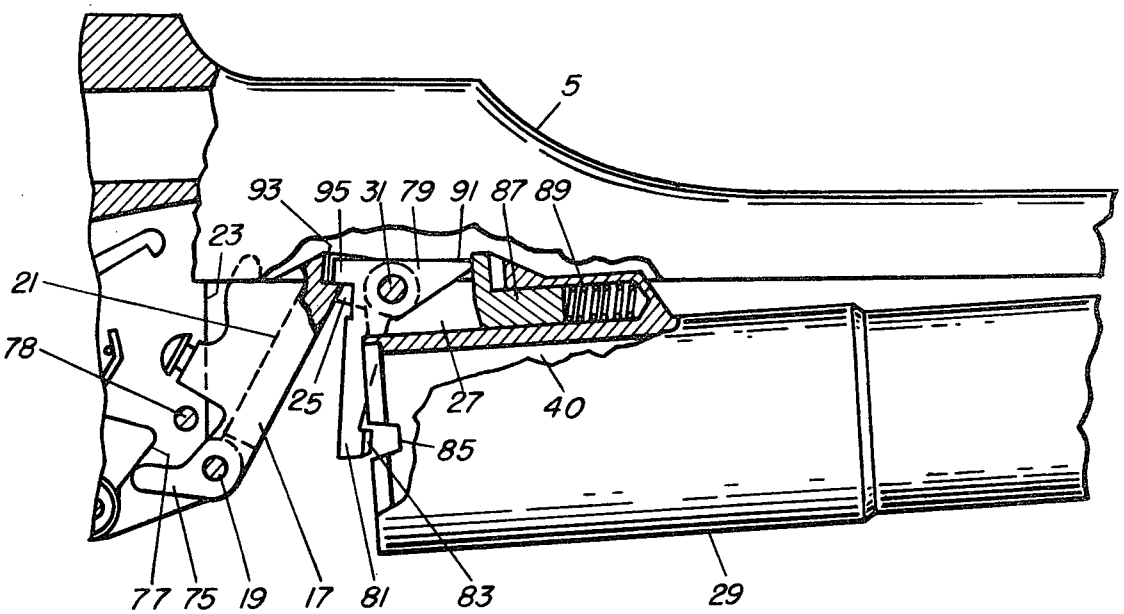
FIG. 2 is a fragmentary right side view, partly in axial section, of the firearm, with the breech partially opened.

An extractor-ejector lever 79, pivoted on the pivotal connection 31, comprises a lower arm 81 that extends around the barrel 29 and has an extractor claw 83 positioned in a notch 85 in the chamber 40 (behind the rim of a cartridge therein) in firing position. Lever 79 is biased in this position by a spring-biased slide 87, mounted in a channel 89 in the barrel 29, which engages the end of a forward- and upward-extending arm 91 on the lever 79. The lever 79 is actuated, during the opening of the breech, by the engagement of a notch 93 in the upper end of the breech block 17 with a rearward-extending arm 95 on the lever 79, as shown in FIGS. 2 and 3, to eject the fired case from the chamber 40.

The breech is closed, after insertion of fresh cartridge, by grasping the grip 73 and reversing the operation described above for the opening of the breech, that is, by moving the barrel 29 upward and rearward to the position shown in FIG. 1B, with the hammer 43 held in cocked position, the breech block portion 21 abutting the receiver abutment 23, the extractor claw 83 disposed in notch 85, and the latch 63 locking the breech block 17 in its closed position, ready for firing.

Figure 4:
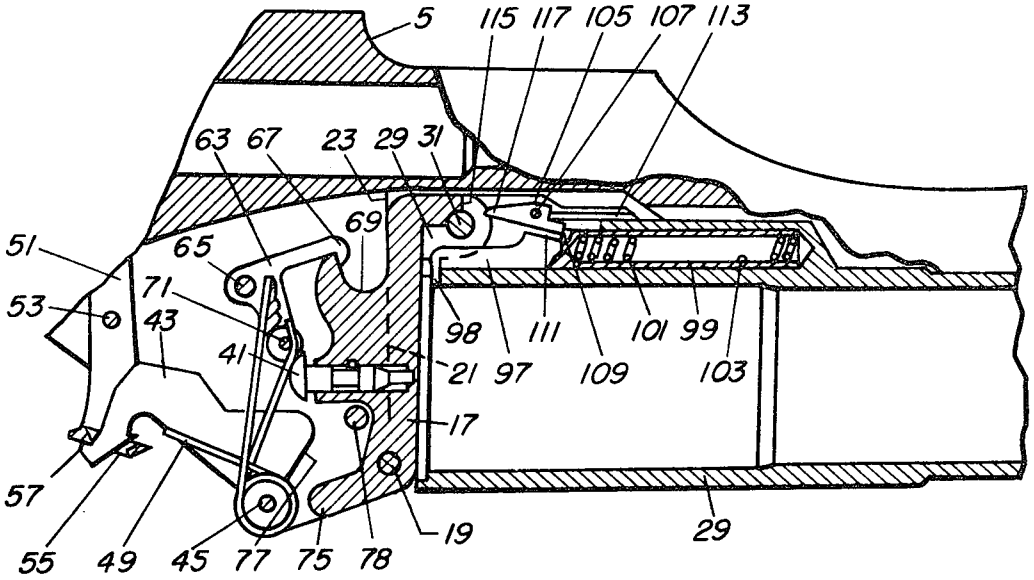
FIG. 4 is a fragmentary side view, partly in section, of a modified firearm having a different kind of cartridge ejector, with the breech closed.
Figure 5:
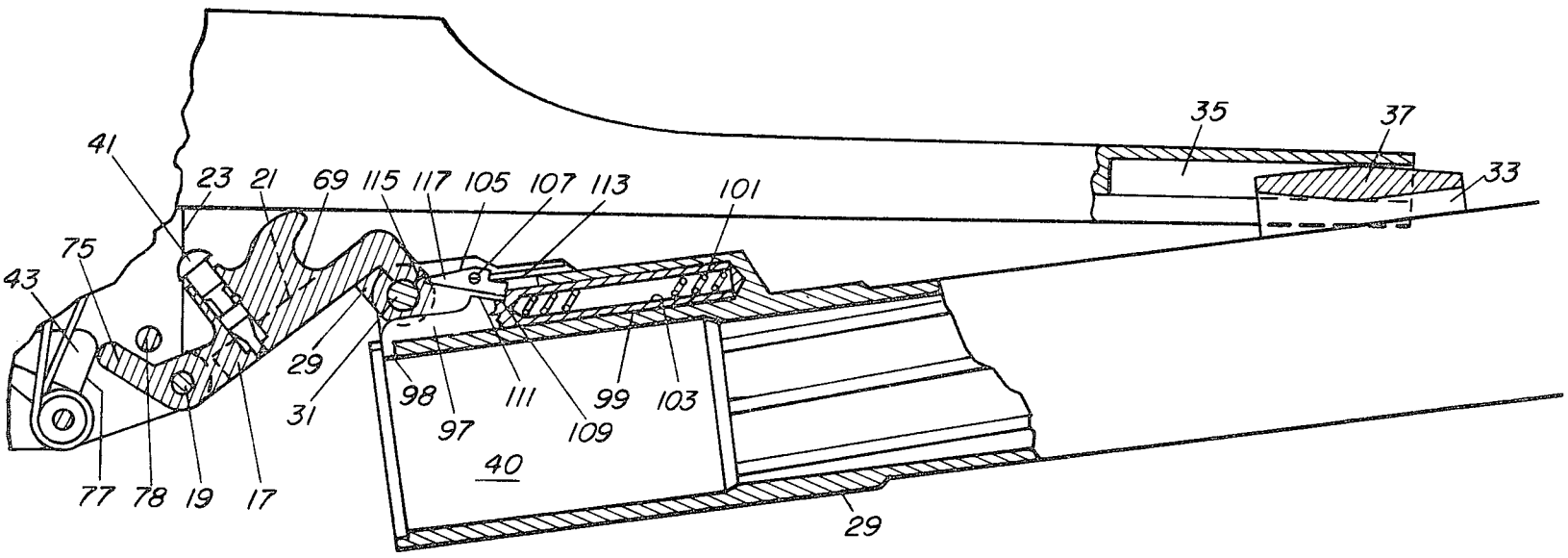
FIG. 5 is a similar view of the firearm of FIG. 4, with the breech just before reaching its fully open position.

FIGS. 4 and 5 show the present invention embodied in a firearm having an extractor-ejector member that is slidable, instead of pivoted. The same numerals are used in FIGS. 4 and 5 for parts substantially the same as the corresponding parts in FIGS. 1A to 3. An elongated extractor-ejector slide 97 having an extractor claw 98 is slidably mounted in a longitudinal channel 99 in the upper wall of the barrel 29. Slide 99 is biased rearwardly by a coil spring 101 disposed in a bore 103 in the slide 99. Extracting movement of the slide 97 prior to and during most of the opening of the breech is prevented by a lever 105 pivoted at 107 on the receiver and having a forward-facing shoulder 109 engaged in a notch 111 in the slide 99, as shown in FIGS. 4 and 5. A leaf spring 113 biases the lever 105 toward the locking position. The lever 105 is disengaged from the notch 111 just before the breech is fully open, by engagement of a shoulder 115 on the arm 29 of the breech block 17 with the upper surface of a rearward-extending arm 117 of lever 105 (FIG. 5).

The foregoing disclosure and drawings are merely illustrative of the principles of this invention and are not to be interpreted in a limiting sense. I wish it to be understood that I do not desire to be limited to exact details of construction shown and described, because obvious modifications will occur to a person skilled in the art.

What is claimed is:

1. A breech-loading firearm comprising:

a stationary receiver having a forwardly-facing abutment;

a breech block pivotally mounted near one end on said receiver and having a rearward-facing second abutment engaging said first abutment in firing position;

a barrel slidably mounted near its forward end for forward and rearward movement on said receiver and pivotally connected at its rear end to the other end of said breech block; and means for firing a cartridge disposed in the rear end of said barrel;

whereby forward movement of said barrel to open the breech at the rear of the barrel bore during firing is prevented by said pivotal connection and the rearward reaction of the expanding gases on said breech block, but said barrel and said other end of said breech block can be moved forwardly after firing to open the breech.

2. A firearm as in claim 1, wherein said one end and said other end are the lower and upper ends, respectively, of said breech block, and said rear end of said barrel moves forward and downward to open the breech.

3. A firearm as in claim 1, further comprising a breech block latch movably mounted on said receiver, with a spring biasing said latch into latching engagement with said breech block, to prevent movement thereof to open the breech before firing, and means for releasing said latch.

4. A firearm as in claim 3, wherein said latch is automatically released by said firing means during firing.

5. A firearm as in claim 4, wherein said firing means comprises a firing pin slidable in said breech block, and a spring-actuated hammer carried by said receiver and engageable with said firing pin to drive the latter into the cartridge; and said releasing means comprises a shoulder on said hammer engageable with said latch in its firing movement to release said latch from said breech block.

6. A firearm as in claim 1, further comprising means actuated by the opening of the breech for extracting and ejecting a cartridge from a chamber in said rear end of said barrel bore.

7. A firearm as in claim 6, wherein the last-named means comprises an extractor-ejector member, pivotally mounted on the pivotal connection between said barrel and said breech block, and comprising an extracting claw disposed in said chamber and an arm engageable by a shoulder on said breech block during the opening of the breech.

8. A firearm as in claim 6, wherein the last-named means comprises an extractor-ejector member slidably mounted on said barrel and having an extracting claw disposed in said chamber, a spring biasing said member rearward, a spring-biased latch pivotably mounted on said barrel and engaged with said member to prevent rearward movement thereof, and a shoulder on said breech block engageable with said latch during the opening of the breech to release said latch from said member.

9. A firearm as in claim 2, further comprising means actuated by the opening of the breech for cocking said firing means.

10. A firearm as in claim 9, wherein said firing means comprises a firing pin slidable in said breech block and a hammer pivoted on said receiver and engageable with said firing pin to fire the cartridge, and said cocking means comprises a rearward-extending arm on said breech block which engages a shoulder on said hammer and pivots the latter to cocked position during the opening of the breech.

* * * * *